United States Patent [19]

Erdman et al.

[11] 4,355,724

[45] Oct. 26, 1982

[54] APPARATUS FOR SENSING DEPRESSIONS IN TOP PANELS OF CONTAINERS

[75] Inventors: Frank H. Erdman, Newtown Square, Pa.; William Ellis, Bradenton, Fla.

[73] Assignee: Tropicana Products, Inc., Bradenton, Fla.

[21] Appl. No.: 160,498

[22] Filed: Jun. 18, 1980

[51] Int. Cl.[3] ..... B07C 5/00

[52] U.S. Cl. ..... 209/529; 209/531; 209/570; 209/597; 209/598

[58] Field of Search ..... 209/529, 530, 531, 567, 209/570; 234/226, 228, 236, 246

[56] References Cited

U.S. PATENT DOCUMENTS

| | | | |
|---|---|---|---|
| 3,206,027 | 9/1965 | Bailey | 209/529 |
| 3,266,627 | 8/1966 | Ochs | 209/529 |
| 3,295,676 | 1/1967 | Ochs | 209/529 |
| 3,301,399 | 1/1967 | Ochs | 209/529 |
| 3,392,829 | 7/1968 | Keinanen | 209/529 |
| 3,441,132 | 4/1969 | Browning | 209/529 |
| 3,469,686 | 9/1969 | O'Neill, Jr. | 209/529 |

*Primary Examiner*—Allen N. Knowles
*Attorney, Agent, or Firm*—Burns, Doane, Swecker & Mathis

[57] ABSTRACT

Apparatus for detecting whether the top panel of a container cap is properly depressed as capped containers are conveyed along a travel path. The apparatus is of the type comprising a floating shoe disposed over the travel path and carrying a proximity sensor. The shoe includes a reference portion arranged to be contacted by the caps to conform the shoe to the orientation of the cap. The floating shoe is mounted for lateral movement and includes guide flanges. The flanges extend generally fore-to-aft and are arranged to be contacted by the caps to shift the shoe laterally so as to position the proximity sensor over the same portions of successive caps. If caps of non-metallic material are being sensed, a metal spring member is carried by the shoe and is arranged to be contacted by the top panel of each cap and assume a spacing from the proximity sensor in accordance with the degree of depression of the top panel. The proximity sensor is directed toward the spring member to sense the latter.

19 Claims, 7 Drawing Figures

APPARATUS FOR SENSING DEPRESSIONS IN TOP PANELS OF CONTAINERS

BACKGROUND AND OBJECTS OF THE INVENTION

The present invention relates to the capping of containers to form a seal and, in particular, to the sensing of the integrity of the seal.

The capping of containers is often performed in conjunction with a procedure whereby air is removed from the container to preserve the freshness of the product. One technique for removing the air involves the formation of a vacuum within the container as the container is capped. This can be achieved, for example, by injecting steam into the top of the container just as the cap is applied. When the steam condenses, the vacuum is created.

The vacuum is maintained by employing a cap which creates an air-tight seal around the container mouth. For quality control purposes, it is necessary to verify the integrity of the seal before the container is shipped. This can be done by inspecting the degree of concavity of the top panel of the cap. In this regard, the top panel of the cap, such as in the case of plastic caps, will be drawn-in upon the creation of the vacuum to form a depression or concavity in the panel. By inspecting the panel, it can be determined whether the vacuum has been maintained.

Inspection of the concavity in the top of the cap can be performed visually by trained personnel. Although such visual detection can be reliable, it would be economical as well as reliable to perform that function automatically. One factor adversely affecting the ability to automate that function involves the minute dimensions which must be detected. Thus, equipment is required which is highly sensitive, yet very reliable. This is especially true in connection with plastic caps which do not necessarily snap-back to a fully undepressed condition when the vacuum seal is broken, as do metal caps.

Certain types of prior art detection equipment contain plates which are mounted for pivotal movement in one or more directions to seat upon the metal cap of a container as containers are fed past the plate upon a conveyor. An electrical proximity sensor is mounted on the plate and is aimed at the top panel of the cap to determine the amount of depression thereof. A signal generated in response to the detection of an improperly depressed cap causes an ejector to push the container from the conveyor line. Exemplary of prior art detecting equipment are the disclosures in U.S. Pat. No. 3,206,025 issued to Ochs on Sept. 14, 1965; U.S. Pat. No. 3,371,781 issued to Armbruster et al on Mar. 5, 1968; and U.S. Pat. No. 3,465,878 issued to Ochs on Sept. 9, 1969.

In prior art systems rigid bumpers or guides engage the sides of the containers to confine the containers to a pre-defined path of travel beneath the sensor and thereby create proper alignment between the can and sensor. However, such bumpers cannot insure against misalignment between the guides and sensor caused by wear, deformations, etc., in one or both of such sensor and guides.

Furthermore, proximity sensors operate by sensing the metal in the cap and thus are not suitable in connection with plastic caps which are being used in increasing numbers.

It is, therefore, an object of the present invention to minimize or obviate problems of the type discussed above.

It is another object of the present invention to provide novel apparatus for inspecting the depression in a capped container.

A further object of the invention is to automatically inspect depressions in caps formed of plastic.

An additional object of the invention is to provide such an inspection apparatus which insures against misalignment between the sensor and caps fed therepast.

SUMMARY OF THE INVENTION

These objects are achieved by the present invention which involves apparatus for detecting whether the top panel of a container cap is properly depressed as capped containers are conveyed along a travel path. The apparatus is of the type comprising a floating shoe disposed over the travel path and carrying a sensing element. The shoe includes a reference portion arranged to be contacted by the caps to conform the shoe to the orientation of the cap. The floating shoe includes guide flanges movable with the reference portion. The flanges extend generally fore-to-aft and are arranged to be contacted by the caps to maintain a predetermined lateral alignment between the cap and sensing element so that the sensing element is positioned over the same place on successive caps.

Preferably, the shoe is mounted for lateral movement, with the flanges arranged to urge the shoe laterally when contacted by a cap.

Preferably, the sensing element is a proximity sensor. If the caps are of non-metallic material, a metal spring member can be carried by the shoe and arranged to be contacted by the top panel of each cap and assume a spacing from the proximity sensor in accordance with the degree of depression of the top panel. The proximity sensor is directed toward the spring member to sense the latter.

THE DRAWING

These and other objects and advantages of the invention will become apparent from the following detailed description of a preferred embodiment thereof in connection with the accompanying drawings in which like numerals designate like elements, and in which.

Figure 4:
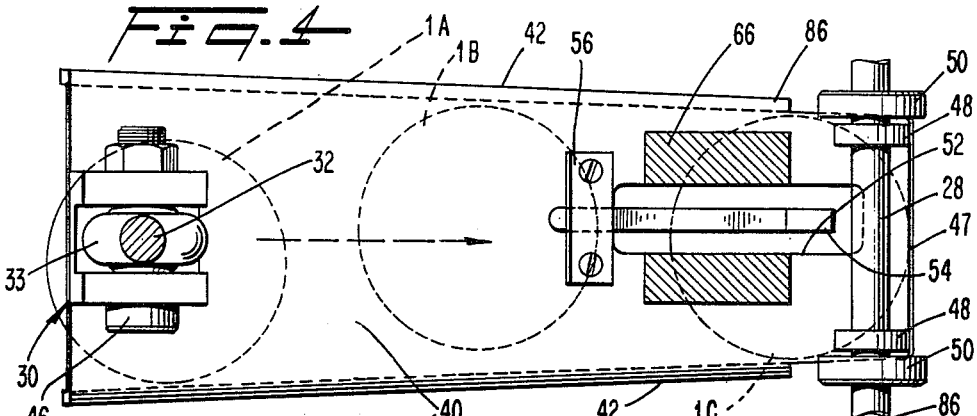
FIG. 4 is a plan view of a detecting shoe according to the present invention, with the sensing member removed for clarity.
Figure 5:
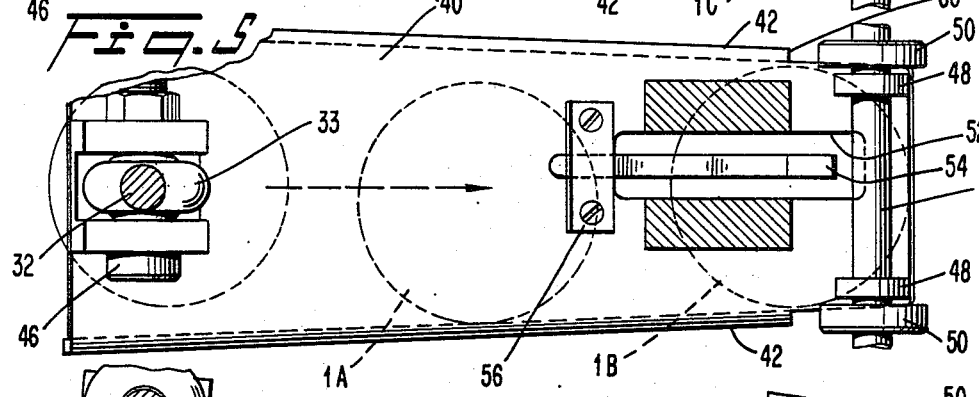
Figure 4A:
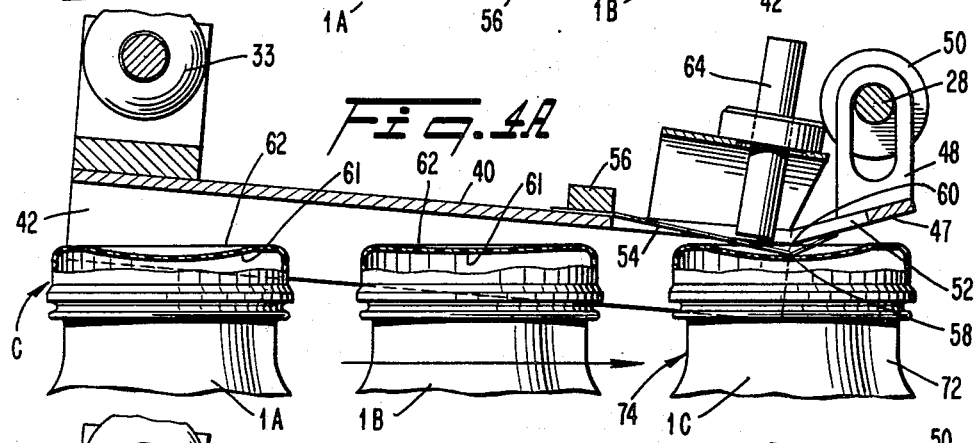
Figure 5A:
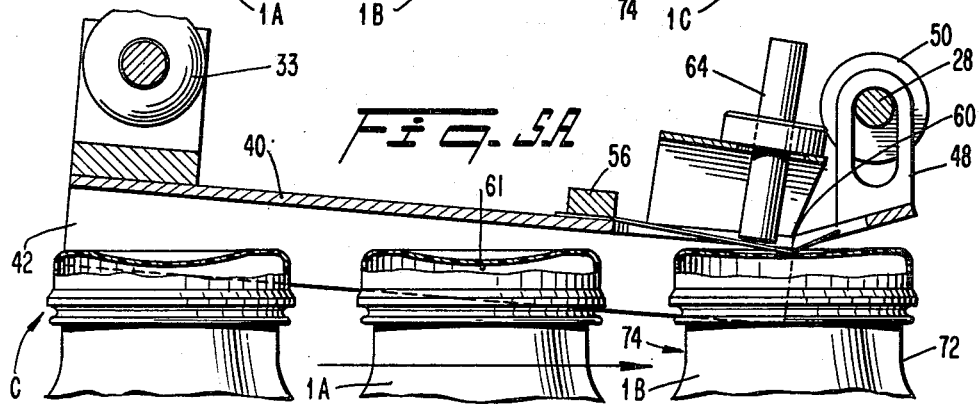

FIG. 4*a* is a longitudinal sectional view through the shoe, depicting the sensing member;

FIG. 5 is a view similar to FIG. 4 in which the sensing position of the shoe is occupied by a defective cap; and FIG. 5*a* is a longitudinal sectional view of the shoe depicted in FIG. 5.

DETAILED DESCRIPTION OF A PREFERRED EMBODIMENT OF THE INVENTION

Figure 1:
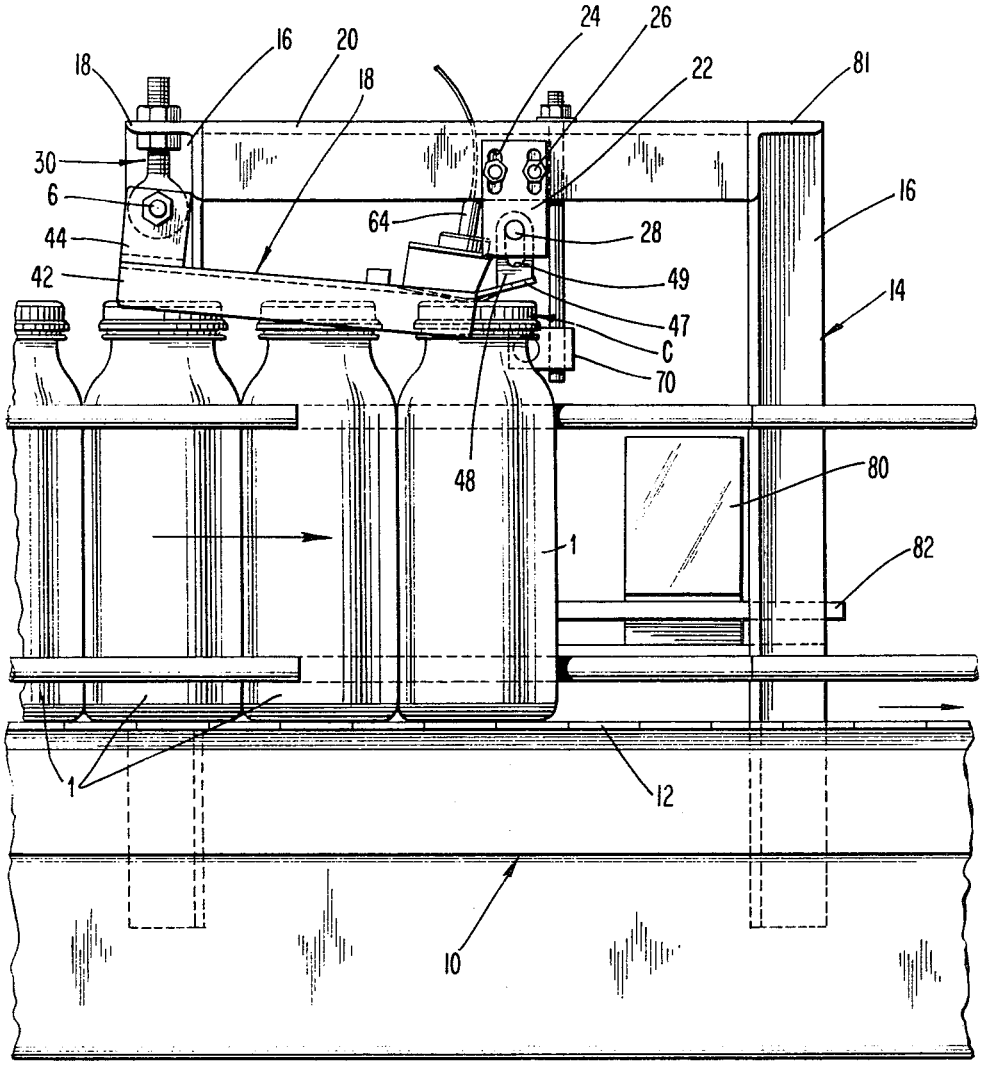
FIG. 1 is a side elevational view of a cap detecting apparatus according to the present invention as capped bottles are fed therepast from left to right.
Figure 2:
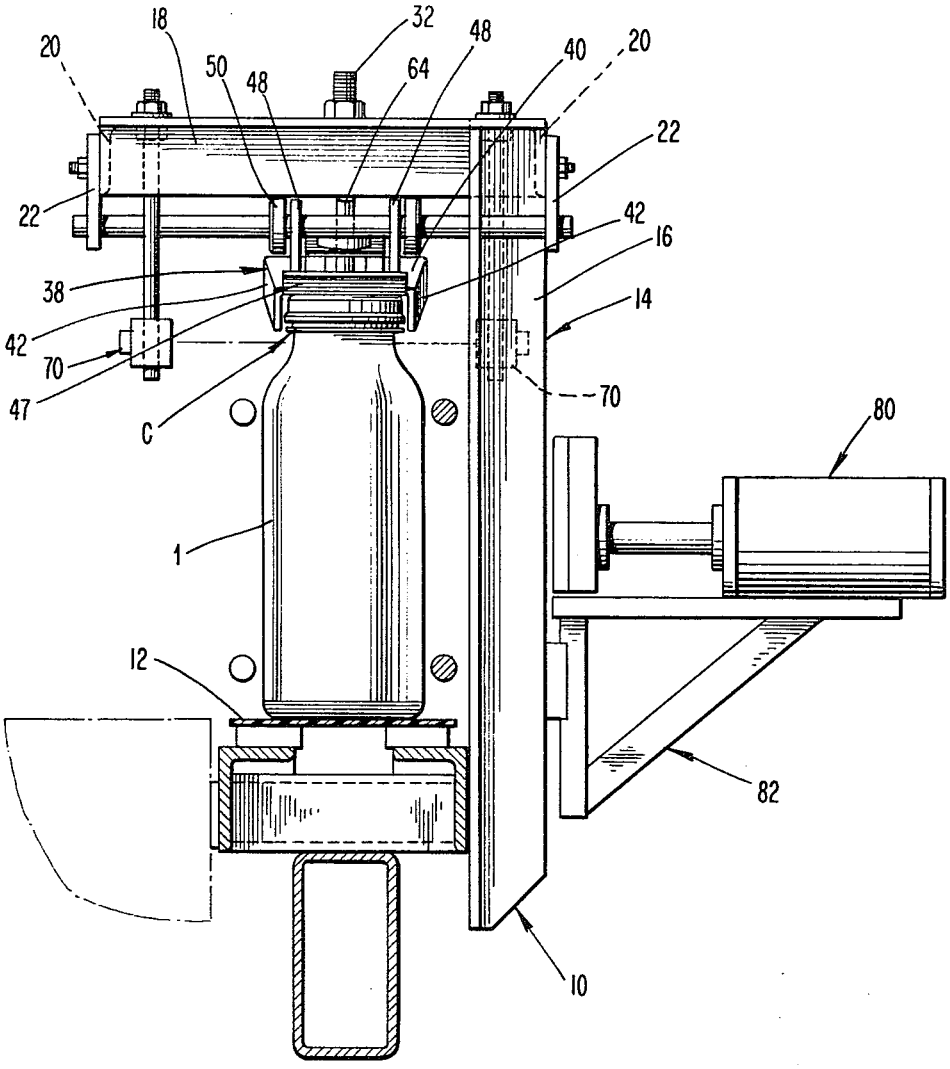
FIG. 2 is a front view of the apparatus depicted in FIG. 1, i.e., as viewed from the right-hand side of FIG. 1.
Figure 3:
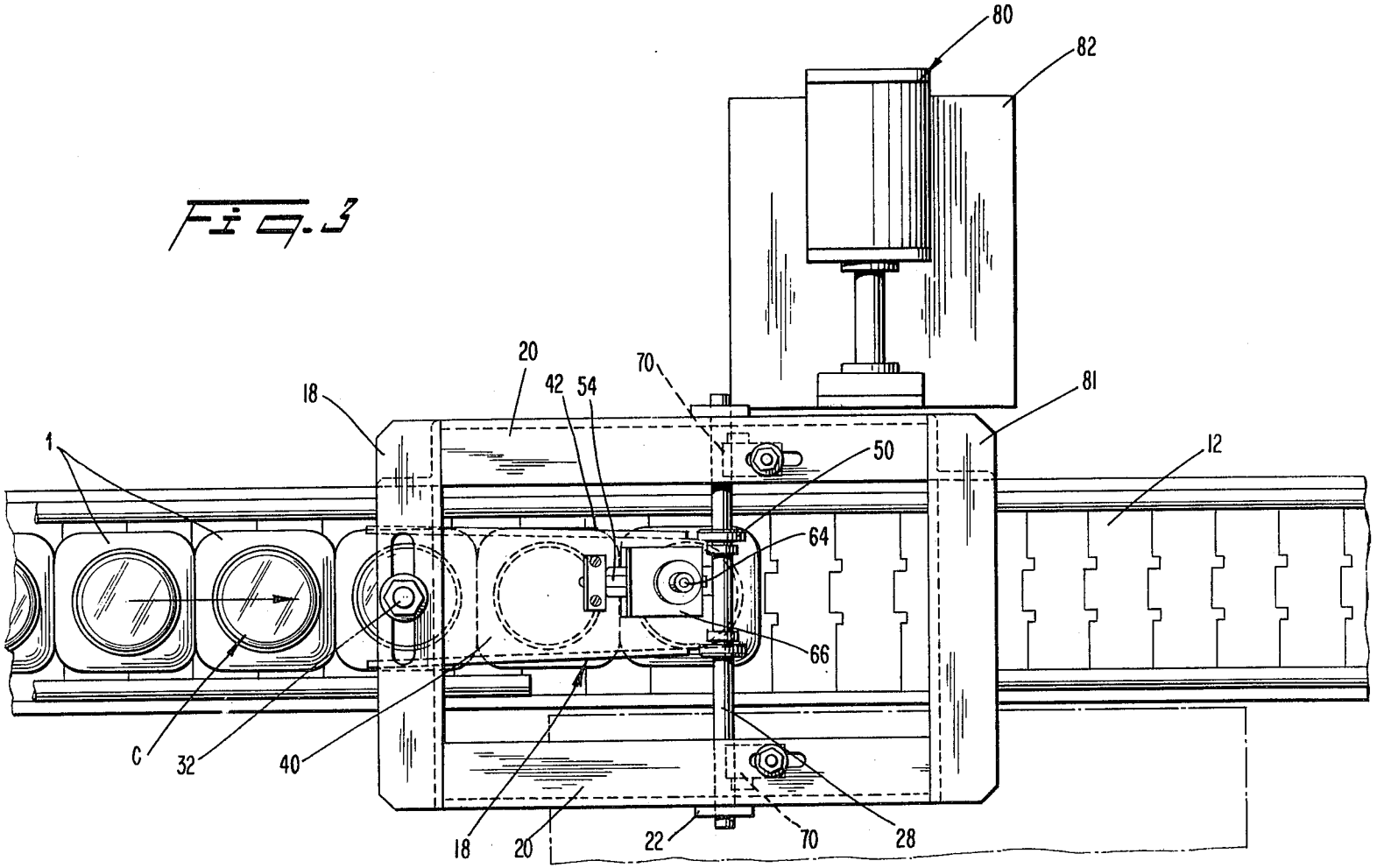
FIG. 3 is a plan view of the apparatus according to FIG. 1.

A preferred container cap inspection system according to the present invention includes a frame 10 supporting an endless horizontal conveyor 12 of any suitable type. Connected to the frame is a support structure 14 comprising a pair of upstanding posts 16 spaced in the direction of conveyor travel. Four arms 18, 20 are carried by the posts (FIG. 3) and overlie the conveyor. Two of the arms 20 are mutually parallel and support a pair of depending brackets 22. The brackets are mounted for vertical and tilting adjustment by means of slots 24 and attachment bolts 26. A rod 28 has its ends mounted in the brackets and extends horizontally across the conveyor 12 in vertically spaced relationship thereabove.

Hanging from a leading one of the other arms 18 is a conventional universal pivot 30 which comprises a unitary assembly of a rod 32 and a spherical segment 34 freely rotatably mounted in a socket 33 at a lower end of the rod (FIGS. 4–5). The rod is threadedly connected to the arm 18 so as to be vertically adjustable.

Mounted on the support structure 14 is a movable guide or shoe 38 which comprises a flat top wall 40 and a pair of depending side walls 42 which are laterally spaced and extend generally in the direction of travel of the containers. At a leading end of the shoe there are disposed a pair of upstanding ears 44 which receive the spherical segment therebetween and are secured thereto by means of a bolt 46 extending through the ears 44 and the spherical segment 34. The spherical segment is thus connected to the shoe 18 and swings freely within the socket 33 to provide a universal pivot mount for the leading end of the shoe 38.

At a trailing end of the shoe 38 there are provided a pair of laterally spaced upstanding brackets 48 each mounted on an upwardly inclined extension 47 of the shoe and containing a vertical slot 49. The slots 49 are horizontally aligned and loosely receive the rod 28. The shoe 38 is free to move a limited extent in all directions about the universal coupling 30 and is constrained in the vertical direction by the lost-motion pin and slot coupling 48-49. That is, the pin and slot coupling is deliberately made loose enough to enable the trailing end of the shoe to swing vertically about a horizontal axis transverse to the direction of container movement, laterally about a vertical axis, and to tilt about a horizontal axis disposed parallel to the direction of container movement. The primary function of the pin and slot coupling is to define the lower position of the trailing end of the floating shoe.

A pair of stop members 50 are mounted on the pin 28 to limit the amount of lateral shoe displacement.

Disposed in the top wall 40 of the shoe 38 is a slot 52 extending parallel to the direction of container travel (FIGS. 4–5).

Mounted on the top wall 40 of the shoe 38 is a metallic spring finger 54. A leading end of the finger 54 is anchored to the top wall 40 of the shoe by means of a removable block 56. The spring extends downwardly through the slot 52 and is bent upwardly at its trailing end to form an edge 58. The edge 58 is disposed directly beneath an edge 60 formed by the junction of the top wall 40 and the extension 47.

The pin and slot connection 48-49 is arranged so that the top wall 40 of the shoe 38 is normally disposed at a slight downward inclination from front to rear and wherein the edge 60 of the shoe is located at a level slightly below the tops of the container caps C to assure that the top rim 62 of each cap C will engage the edge 60 as the containers B travel therepast.

The edge 58 of the spring finger 54 is spaced beneath the edge 60 of the wall 40 by a distance corresponding to the normal distance between the top rim 62 and a preselected spot on the properly depressed top panel 61 of the cap C.

Mounted on the top wall 40 of the shoe 38 is a sensing element 64. The sensing element 64 is fixed on the shoe by a carrier 66 so as to overlie the slot 52. The sensor preferably comprises a conventional proximity sensor which emits a signal when a metallic surface is sensed to be closer (or farther) than a predetermined distance. In this case, the surface being sensed is that of the metallic spring finger toward which the sensor is directed. In this regard, when the cap C travels past the shoe 38, the edge 60 of the shoe slides upon the rim 62 of the cap and the edge 58 of the spring finger slides upon the depressed panel of the cap. The edge 60 defines a reference for the sensor 64 because the edge 60 and sensor 64 are relatively immovable. Thus, if the panel is properly depressed (FIG. 4A), the distance between the sensor 64 and the region of the spring finger sensed by the sensor will correspond to a preselected value, whereby no signal is emitted. However, if the panel 61 is not properly depressed (see container 1B in FIG. 5A), the distance between the spring finger 54 and the sensor 64 will be less than the preselected value, resulting in the sensor emitting a signal.

It should be noted that if the vacuum seal is broken, the top panel 61 of the plastic cap does not necessarily spring back to a position level with the rim 62, due to the cold flow of the panel which may have occurred. Thus, even when the vacuum seal is broken, the panel 61 may still be somewhat depressed (see the cap of container 1B in FIGS. 4A, 5A).

It should be mentioned that the conventional proximity sensor 64 can be employed to emit a signal if the spring finger is spaced farther than the predetermined value from the sensor. Such a mode of operation could be employed to detect the absence of a cap on the container.

In order to actuate the proximity sensor to assure that detection is effected exactly at a preselected place on the panel 61, a photocell 70 is mounted on the support structure 14 to sense a leading edge 72 of the container neck 74 as is conventional. The proximity sensor 64 and photocell are interconnected such that when the photocell 70 is actuated by the container neck, the edge 58 of the spring finger 54 will engage the predetermined place on the panel 61. Accordingly, the same places on successive caps will be detected.

Disposed downstream of the floating shoe is an ejector arm 80 which is mounted on a rigid platform 82. The ejector arm comprises a fluid-actuated ram which is operated by an electric solenoid valve, the latter being actuated by a signal from the proximity sensor to eject a container carrying a faulty cap from the path of travel. Preferably, the proximity sensor is connected to a conventional timer or counter which actuates the ejector arm a preselected time period after a faulty cap is detected. That time period can be correlated to the speed of conveyor travel to assure that the container carrying the faulty cap is disposed opposite the ejector at the end of the time period.

The guide flanges converge toward the reference portion defined by a trailing portion of the top wall.

As noted earlier, the shoe 38 includes depending flanges 42. Those flanges converge toward the end of the shoe carrying the sensor 64. The flanges terminate at the edges 58, 60 and, at such point 86 of flange termination, the spacing between the flanges is essentially the same as the cap diameter. It will be appreciated that as the caps travel between the flanges 42 toward the sensor 64, engagement between the cap and the flanges 42 serves to laterally displace the cap and/or the shoe so that when the sensor 64 is actuated by the photocell 70, the preselected place on the cap panel 61 is engaged by the edge 58 of the spring finger. Such alignment is assured, even though one or more subsequent caps 1A, 1B are traveling between the flanges as a preceeding cap 1C is being sensed by the sensor 64. That is, if contact occurs between such subsequent caps and the flanges in a manner displacing the shoe just as the preceeding cap 1C is being sensed, no error occurs, because the preceeding cap will be likewise displaced with the shoe, due to contact between the preceeding cap and the terminal ends of the converging flanges.

It should also be mentioned that in the fabrication of plastic caps, a projection or nipple may be formed at the center of the top panel 61 of the cap, which projection may not be of uniform height from one cap to another. Therefore, it is not desirable to sense the center of the panel. For that reason, the proximity sensor 64 and spring finger 54 are located closer to one of the guide flanges than the other, so that the edge 58 will contact an off-center portion of the panel 61.

IN OPERATION, capped containers are fed by the conveyor 12 along a travel path beneath the floating shoe 38. The leading end of the shoe is disposed above the level of the caps C to avoid engagement thereby. The caps are received between the leading edges of the guide flanges 42, which edges converge toward the trailing end of the floating head. As the cap advances toward the proximity sensor 64, engagement between the cap C and guide flanges 42 serves to move the floating shoe laterally so as to create proper lateral alignment between the shoe and the cap. When the cap reaches the trailing end of the shoe, the guide flanges will be fully converged, assuring that a precise lateral alignment exists. Moreover, the cap engages the reference edge 60 of the top wall 40 at the trailing end of the latter, to vertically raise the shoe and, if necessary, tilt the shoe about a generally fore-to-aft axis. The edge 58 of the spring finger engages the cap panel 61 so that the spring finger 54 assumes a spacing from the proximity switch which is a function of the depth of the depression at the spot thereof being sensed. When the photocell 70 is actuated by the leading edge 72 of the container neck, the proximity sensor is actuated. If the metallic spring finger is closer to the proximity switch than a preselected distance, a signal is emitted by the proximity switch to actuate a mechanism which causes the ejector arm 80 to be activated to push the container having the faulty cap from the conveyor.

In the event of a container back-up on the conveyor, the inclined extension 47 of the top wall 47 acts as a cam to raise the trailing end of the shoe and prevent damgage thereof.

It will be appreciated that the present invention assures that the sensor will be properly positioned above a target spot on the top surface of a cap. Lateral misalignments cannot occur due to the rigid relationship between the proximity sensor and the depending guide flanges.

A conventional metal-sensitive proximity sensor can be utilized even in conjunction with non-metallic caps due to the provision of the metal spring finger arranged to contact the top panel of the cap. If desired, a shoe according to the present invention, with or without the spring finger, can be employed to detect metallic caps.

Although the invention has been described in connection with a preferred embodiment thereof, it will be appreciated by those skilled in the art that additions, substitutions, deletions and modifications not specifically described, may be made without departing from the spirit and scope of the invention as defined in the appended claims.

What is claimed is:

1. In apparatus for detecting whether the top panel of a container cap is properly depressed as capped containers are conveyed along a travel path, said apparatus being of the type comprising a floating shoe disposed over the travel path and carrying a sensing element, said shoe including a reference portion arranged to be contacted by the caps to conform the shoe to the orientation of the cap, the improvement wherein said floating shoe includes guide flange means movable with said reference portion and extending generally fore-to-aft and arranged to be contacted by the caps to maintain a predetermined lateral alignment between said cap and said sensing element so that said sensing element is positioned over the same place on successive caps.

2. Apparatus according to claim 1, wherein said shoe is mounted for lateral movement, said flange means arranged to urge said shoe laterally when contacted by a cap.

3. Apparatus according to claim 2, wherein said guide flange means comprises a pair of laterally spaced guide flanges converging in the direction of container travel, the spacing between said flanges adjacent said sensing element being substantially the same as the cap diameter.

4. Apparatus according to claim 3, which is adapted to sense plastic caps, said sensor element comprising a proximity sensor fixedly mounted on said shoe, a metal spring member carried by said shoe and arranged to be contacted by the top panel of each cap and assume a spacing from said proximity sensor in accordance with the degree of depression of said top panel, said proximity sensor being directed toward said spring member to sense the latter.

5. Apparatus according to claim 3, wherein said sensing element is located closer to one guide flange than the other such that an off-center portion of the cap surface is detected.

6. Apparatus according to claim 3, wherein said shoe comprises a top wall, said guide flanges depending from said top wall, said shoe being mounted such that when in a rest position said top wall is inclined downwardly from its leading end to its trailing end.

7. Apparatus according to claim 5, wherein said trailing end of said top wall includes an upwardly inclined extension.

8. Apparatus according to claim 3, wherein said floating shoe comprises a top wall, said flanges depending downwardly from said top wall, a leading end of said shoe mounted on a spherical mount, said sensing element located adjacent a trailing end of said top wall.

9. Apparatus according to claim 8, including a pin-and-slot connection at the leading end of said shoe limiting the extent of downward vertical travel of said shoe and its reference portion.

10. Apparatus according to claim 3, wherein said flanges converge toward said trailing end of said shoe.

11. Apparatus according to claim 1, including means actuating said sensing element when the latter is disposed above a preselected portion of each cap.

12. Apparatus according to claim 1, including a container ejector arranged to displace from the travel path any container whose cap does not contain a sufficiently deep depression, said sensing element being operably connected to said ejector.

13. In apparatus for detecting whether the top panel of a container cap is properly depressed as capped containers are conveyed along a travel path, said apparatus being of the type comprising a floating shoe disposed over the travel path and carrying a proximity sensor, said shoe including a reference portion arranged to be contacted by the caps and being movable vertically and tiltable about a generally fore-to-aft axis to conform the shoe to the orientation of the cap, the improvement wherein said floating shoe comprises a top wall and laterally spaced guide flanges depending therefrom and extending in generally fore-to-aft directions, said shoe including a leading end mounted by a universal coupling, and a movable trailing end, said top wall inclined downwardly from said leading end to said trailing end when in a rest position; said reference portion being engaged by said caps to displace said shoe about said universal coupling to conform said shoe to the orientation of said caps, said guide flanges converging toward said trailing end and being engageable by the caps to displace said shoe laterally, the minimum spacing between said flanges being substantially the same as the cap diameter to assure that the sensing element senses the same spot on successive caps.

14. Apparatus according to claim 13, which is adapted to sense plastic caps, a metal spring member carried by said top wall of said shoe and arranged to be contacted by the top panel of each cap and assume a spacing from said proximity sensor in accordance with the depth of the depression of the top panel, said proximity sensor directed toward said spring member to sense the latter.

15. Apparatus according to claim 14, wherein said proximity sensor is located closer to one guide flange than the other such that an off-center portion of the cap panel is detected.

16. Apparatus according to claim 13, wherein said trailing end of said top wall includes an upwardly inclined extension.

17. Apparatus according to claim 13, wherein said universal coupling comprises a spherical member.

18. Apparatus according to claim 13, wherein said trailing end is mounted on a lost-motion coupling comprising a pin-and-slot connection.

19. In apparatus for detecting whether a top panel of a container cap is properly depressed as capped containers are conveyed along a travel path, said apparatus being of the type comprising a floating shoe disposed over the travel path and carrying a proximity switch, said shoe including a reference portion arranged to be contacted by the caps to conform the shoe to the orientation of the cap, the improvement wherein the containers have plastic caps, a metal spring finger being mounted on said shoe and arranged to be contacted by the top panel of each cap and assume a spacing from said proximity switch in accordance with a depression in the cap panel, said proximity switch being directed toward said spring finger to sense the latter.

* * * * *